United States Patent [19]

Venning et al.

[11] Patent Number: 4,541,506

[45] Date of Patent: Sep. 17, 1985

[54] EXHAUST DIFFUSION APPARATUS

[76] Inventors: Scott Venning, 617 S. Busse Rd., Mt. Prospect, Ill. 60056; Anthony Christian, 5500 Carriageway #301, Rolling Meadows, Ill. 60008

[21] Appl. No.: 370,160

[22] Filed: Apr. 21, 1982

[51] Int. Cl.[4] ..... F01N 1/00

[52] U.S. Cl. ..... 181/254; 181/239

[58] Field of Search ..... 181/227, 237, 267, 271, 181/254, 404, 240, 278, 231, 239, 277; 251/96

[56] References Cited

U.S. PATENT DOCUMENTS

| | | | |
|---|---|---|---|
| D. 246,038 | 10/1977 | Moller | D12/194 |
| 1,174,456 | 3/1916 | Wangelin | 251/96 |
| 1,989,675 | 2/1935 | Bobo | 181/254 X |
| 2,072,372 | 3/1937 | Kingsley | 181/254 X |
| 2,740,423 | 4/1956 | Stillwagon | 251/96 |
| 2,954,839 | 10/1960 | Gibel | 181/239 |
| 3,672,773 | 6/1972 | Moller | 181/231 |
| 3,779,342 | 12/1973 | Broberg, Jr. | 181/404 X |
| 3,854,549 | 12/1974 | Moller | 181/277 |
| 3,987,867 | 10/1976 | Moller | 181/231 |
| 4,113,051 | 9/1978 | Moller | 181/231 |

*Primary Examiner*—Benjamin R. Fuller
*Attorney, Agent, or Firm*—Robert V. Jambor

[57] ABSTRACT

An exhaust diffusion apparatus positionable between noise level control and performance modes defining a restricted diffusion passage and an unrestricted exit port for performance operation which may be closed to effect noise level control operation.

3 Claims, 4 Drawing Figures

EXHAUST DIFFUSION APPARATUS

BACKGROUND OF THE INVENTION

1. Field of the Invention

This invention relates to exhaust diffusion apparatus for internal combustion engines. More particularly, it relates to diffusion apparatus intended to minimize operational noise levels to acceptable levels.

2. Description of the Prior Art

High performance engines such as are found in racing boats, racing cars, motorcycles and the like, often include an exhaust system substantially devoid of noise level control. This is necessarily the case, since performance is the primary concern. Noise level control typically interposes restrictions to flow which substantially impede performance.

Often, vehicles of the type described are operated where noise level control is desired, if not mandatory. Many municipalities have enacted ordinances against excessive noise and which impose substantial fines for violations. Operation within the jurisdiction of such a municipality dictates the need for noise reduction.

Efforts have been made to provide diffusion apparatus to reduce the noise level of high performance engines. One example is a product marketed under the mark "SUPER TRAPP" by Gil Marine, Westminster, Calif. This device is adapted to attach to the exhaust system of a high performance racing boat. It includes a plurality of spaced rings which define a plurality of annular paths through which exhaust may pass. The number of rings, and thus, the number of annular exhaust passages, may be varied to vary noise output level. It has been found, however, that to achieve sufficient noise reduction, performance is irreparably impaired, rendering the engine useless for its intended operational mode.

It is the main objective of the present invention to provide an improved diffusion device which effectively dampens exhaust sound where necessary, and permits optimum performance when performance is the intended goal.

SUMMARY OF THE INVENTION

Very generally the present invention is directed to a diffusion device adjustable between two modes of operation, a noise level control mode and a performance mode. The device includes a movable baffle adapted to restrict free flow of exhaust in the control mode. Exhaust gases pass through a series of annular exit ports in a controlled manner, at a restricted noise level. In the performance mode, the baffle is positioned such that it permits essentially unrestricted exhaust flow. Optimum performance is thereby obtained. Should noise restriction be required, the baffle is merely returned to the control mode. Exhaust is then diffused through the defined annular parts at an acceptable noise level.

DETAILED DESCRIPTION OF A PREFERRED EMBODIMENT

Figure 1:
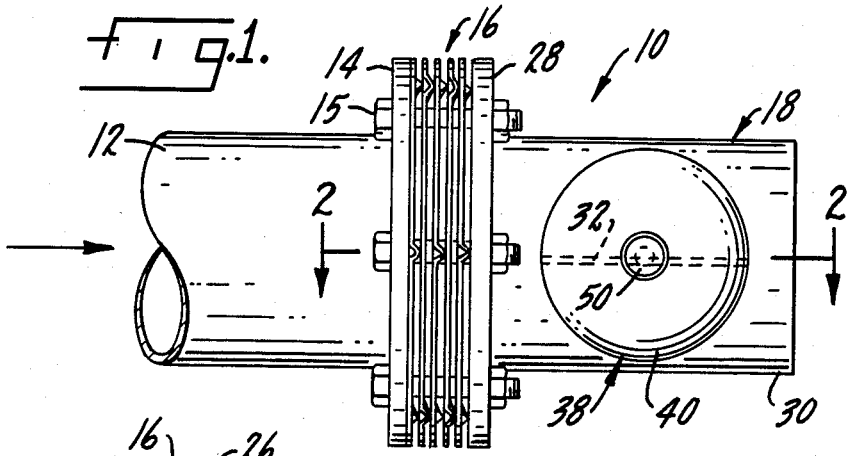
FIG. 1 is a side elevational view of an exhaust system of a high performance engine incorporating a diffusion apparatus illustrative of the principles of the present invention.

Turning now to the drawings, there is illustrated an embodiment of the present invention. As shown in FIG. 1, a diffusion device generally designated 10 is secured to the end of an exhaust manifold 12 of an engine (not shown). In the illustrated embodiment, the exhaust manifold is provided with a bolt flange 14 to receive the diffusion apparatus 10. The apparatus is bolted in place by a series of bolts 15. It should be appreciated, however, that any suitable connection arrangement may be utilized.

Figure 2:
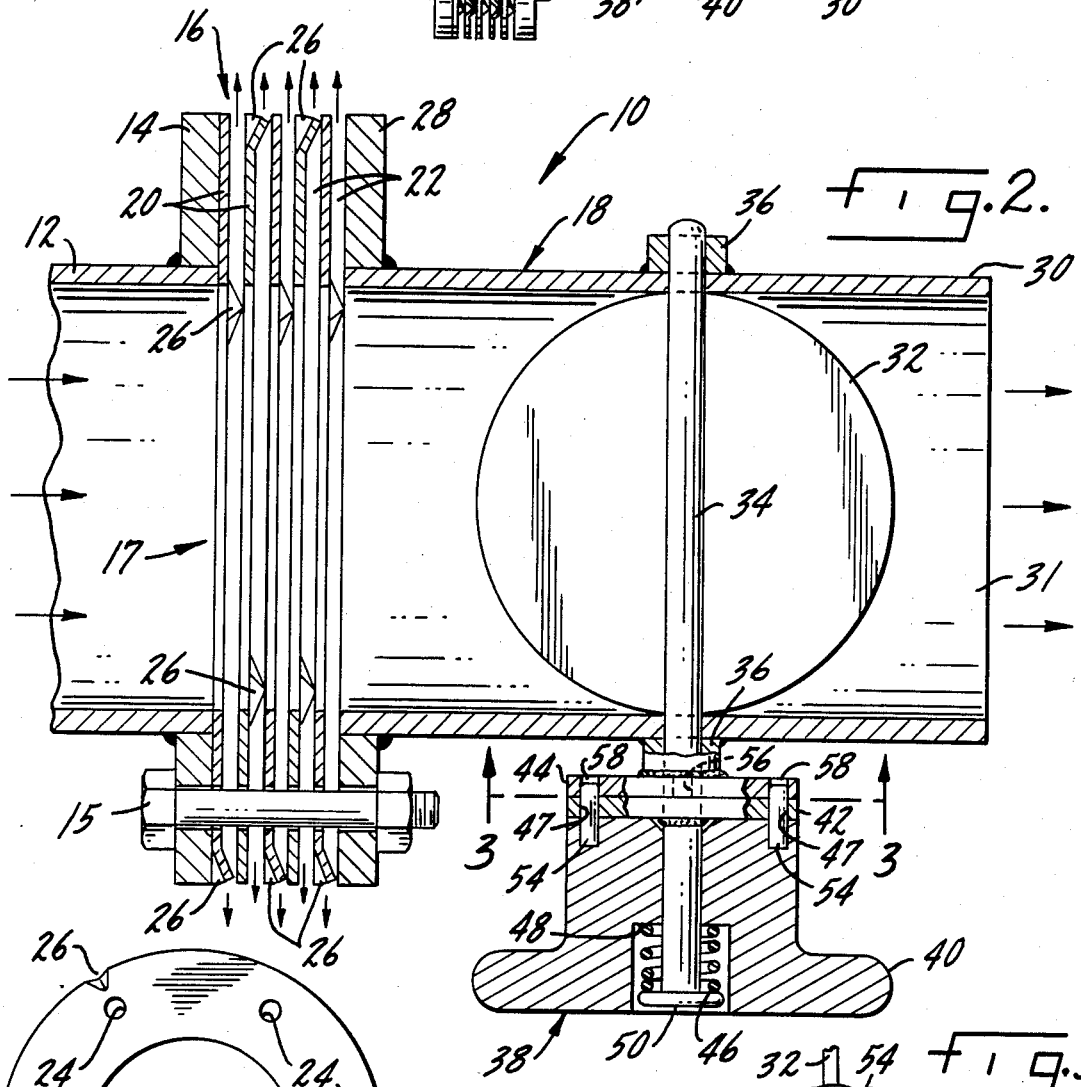
FIG. 2 is a sectional view, on an enlarged scale of the embodiment of the invention illustrated in FIG. 1 and taken along the line 2—2 of FIG. 1.
Figure 4:
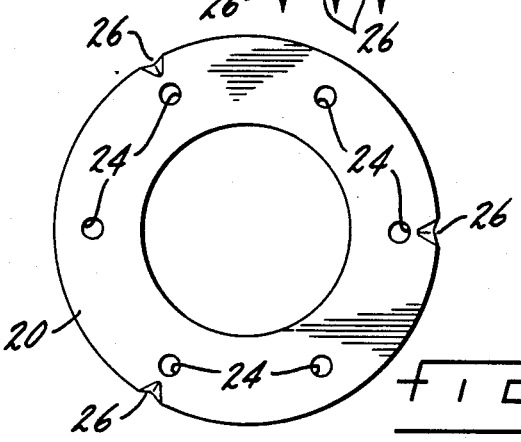
FIG. 4 is a plan view of a diffusion ring which forms a part of the inventive diffusion apparatus of FIG. 1.
Figure 3:
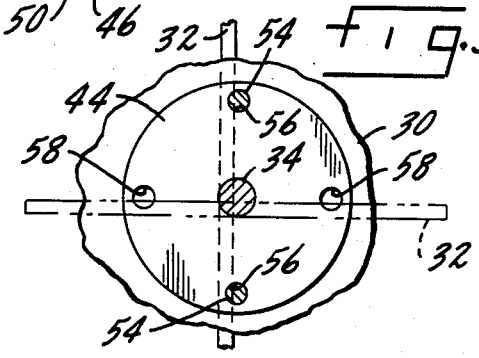
FIG. 3 is a fragmentary elevational view of the invention shown in a control mode, partially in section, taken on the line 3—3 of FIG. 2.

Referring to FIGS. 2 and 3, the diffusion apparatus 10 includes a diffusion passage section generally designated 16, and a valve section 18 adapted to provide the operational mode change contemplated by the present invention.

The diffusion passage section 16 includes a plurality of annular rings 20 which are slightly spaced apart to define a plurality of transverse annular passageways 22 through which exhaust gas may pass. The rings also define a central main passage 17 substantially coextensive with the exhaust manifold which leads to the valve section 18.

As illustrated, the annular rings may incorporate bolt holes 24 to permit passage of bolts 15 which affix the device to the flange 14. The rings also include a series of formed protrusions 26, which are adapted to touch adjacent rings to maintain the rings in spaced relation to define the passageways 22. Alternatively, the annular rings 20 may be flat and annular spacers such as flat washers, or the like, may be interposed between each ring along bolts 15 to provide the necessary spacing.

Valve section 18 includes a base flange 28 bolted to the flange 14 by bolts 15, through rings 20. A tubular body 30 defines an exit passageway 31 in communication with passageway 17 in the diffusion section. It provides an essentially unrestricted flow path for exhaust gases.

The body 30 houses a movable valve in the form of a butterfly 32 affixed to shaft 34. The shaft is rotatably received in the body at bosses 36. Butterfly 32 is sized to essentially close passageway 31 when positioned transversely of the tubular body 30.

Valve operator 38 is provided exterior to the body to permit positioning of the butterfly 32. It comprises a knob 40, rotatable on shaft 34, disc 42 affixed to and rotatable with shaft 34, and disc 44 affixed to one of the bosses 36.

Knob 40 is spring loaded for axial movement on shaft 34 by compression spring 46 located in a recess formed in the knob. The spring coacts between shoulder 48 in the recess and head 50 formed on the end of shaft 34 and urges the knob toward the body 18. Knob 40 is provided with two protruding pins 54 extending toward valve body 30 through two appropriately formed apertures 47 in disc 42. The pins are generally aligned with butterfly 32 and are disposed approximately 180° apart. They are of a length which exceeds the axial thickness of disc 42. The pins protrude from the apertures when the knob is urged against disc 42 by spring 46.

Spring 46 is sized to permit the ends of pins 54 to be drawn entirely within the apertures 47 in disc 42 but prevents them from being entirely withdrawn from that disc. Rotation of the knob 40 therefore, causes rotation of disc 42 through engagement of pins 54 with the disc within apertures 47.

Fixed disc 44 is provided with pairs of location holes 56 and 58. The holes of each pair are disposed approximately 180° apart and the pairs are at substantially right angles to each other. These holes define first and second operational positions for the valve butterfly 32.

Alignment of pins 54 with one pair of holes, such as the holes 56, as shown in solid lines in FIG. 3, permits spring 46 to urge pins 54 into the holes and lock knob 40 against rotation. This fixes butterfly 32 in one mode, in this instance the noise level control mode. When the pins 54 are aligned with holes 58, as shown in phantom lines in FIG. 3, spring 46 urges pins 54 into holes 58 and locks knob 40, and consequently butterfly 32 in its second operating mode, the performance mode.

To provide noise level control, knob 40 is pulled against spring 46 until pins 54 are clear of fixed disc 44. Knob 40 may then be rotated until pins 54 are in alignment with holes 56. This positions butterfly 32 generally transverse of tubular body 30 and effectively closes the flow passageway 31 defined by the body. Exhaust gases are diffused through the annular passageways 22 and exit the system between stacked annular rings 20. Preferably, the total area of the annular passageways 22 is substantially less than the cross-sectional area of passageway 31 of the tubular member 30. A relative size of about 30% of the area of the passageway 31 has been found effective for noise control.

The number of rings utilized will determine the number of annular passageways and the magnitude of noise control. A large number of rings creates a large effective exit port, and hence, reduces the magnitude of noise level control. Conversely, use of fewer rings reduces the number of annular passageways, and increases noise level control. This also increases back pressure and affects performance. The number of rings used must be determined to provide a balance between engine operating characteristics and noise level control.

When the necessity for noise level control is abated, and performance is the objective, knob 40 and butterfly 32 are simply rotated to the performance mode. The knob is pulled against spring 46 until pins 54 pass from the holes 56. Knob 40 is then rotated until the pins are aligned with holes 58. Knob 40 is released and pins 54 lock into holes 58 to limit further rotation of shaft 34.

Butterfly 32 is rotated between positions through the engagement of pins 54 in apertures 47 formed in disc 42. When rotated to the performance position the butterfly is positioned in line with the longitudinal axis of tubular body 30. Exhaust gases may pass directly through passageway 17 and passageway 31 essentially without restriction. Performance will be optimized, though, no noise level control is provided. When noise level control is again required, the knob is merely pulled, and rotated back to the noise level control position. In this way the advantages of both performance and noise level control may be advantageously obtained when needed from a single device.

Various features of the present invention have been shown and described with particular reference to the accompanying drawings. It must be appreciated, however, that numerous modification may be made without departing from the spirit and scope of the invention. For example, a slide valve or other suitable valve may be used. Also a lever or handle could easily replace knob 40.

We claim:

1. An exhaust diffusion device comprising a diffusion section including a plurality of annular rings defining a central passageway in communication with an engine exhaust system, said rings adapted to be retained in spaced apart relation to define a series of transverse open annular passageways; a tubular body defining an open central passageway communicating with the central passageway of said annular rings; movable valve means positioned in said open central passageway of said tubular body and positionable between a first position extending transversely of said passageway, and a second position in general alignment with the longitudinal axis of said passageway, said valve means including a butterfly rotatably supported within said open central passageway of said tubular member upon a shaft extending outwardly of said body, and positioning means being provided to position said butterfly in said first and second positions, and wherein said positioning means includes a knob rotatable upon said shaft and axially movable thereon; a compression spring interposed between said knob and said shaft urging said knob toward said body; a disc fixed to said body and defining at least one position defining aperture; a disc fixed for rotation with said shaft and defining at least one pin receiving aperture, said knob including at least one pin extending through said pin receiving aperture to engage said disc fixed for rotation with said shaft to rotate with said knob, said pin being of a length sufficient to engage said position defining aperture, and adapted to disengage said position defining aperture upon axial movement of said knob against the force of said compression spring.

2. An exhaust diffusion device comprising a diffusion section including a plurality of annular rings defining a central passageway in communication with an engine exhaust system and adapted to be retained in spaced apart relation to define a series of transverse open annular passageways; a tubular body defining an open central passageway communicating with the central passageway of said annular rings; movable vavle means positioned in said open central passageway of said tubular body and positionable between a first position extending transversely of said passageway, and a second position in general alignment with the longitudinal axis of said passageway, the total area of said annular passageways being substantially less than the cross-sectional area of said open central passageway.

3. An exhaust diffusion device as claimed in claim 2 wherein the total area of said open annular passageways is about 30% of the cross-sectional area of said open central passageway.

* * * * *